United States Patent [19]

Oliver

[11] Patent Number: 4,613,302

[45] Date of Patent: Sep. 23, 1986

[54] METHOD AND APPARATUS FOR PROTECTING BOILER IGNITORS

[75] Inventor: Derald Oliver, Castle Dale, Utah

[73] Assignee: Utah Power & Light

[21] Appl. No.: 687,642

[22] Filed: Dec. 31, 1984

[51] Int. Cl.[4] ..... F23Q 3/00

[52] U.S. Cl. ..... 431/263; 431/264

[58] Field of Search ..... 431/263-266, 431/153, 189, 186

[56] References Cited

U.S. PATENT DOCUMENTS

| | | | |
|---|---|---|---|
| 2,665,748 | 1/1954 | Cornelius | 431/265 |
| 2,806,518 | 9/1957 | Poole et al. | 431/153 |
| 3,150,710 | 9/1964 | Miller | 431/265 |
| 4,228,747 | 10/1980 | Smirlock et al. | 431/264 |

OTHER PUBLICATIONS

Babcock and Wilcox Power Generation Group, "Special Operating Instruction for Type MPO Lighter".

*Primary Examiner*—Carroll B. Dority, Jr.
*Attorney, Agent, or Firm*—Workman, Nydegger & Jensen

[57] ABSTRACT

A method and apparatus for protecting ignitor probes used to ignite coal-fired furnaces, such as those used in coal-fired electric generation plants. The invention involves introducing a compressed gas such as compressed air or other inert gas into the ignitor support tube. The gas passes down the support tube and then exits just above the ignitor probe. The gas then passes over the ignitor probe and out into the furnace. The gas protects the probe by insulating it from the environment of the furnace, thus keeping it cool and free from combustion waste products.

19 Claims, 3 Drawing Figures

METHOD AND APPARATUS FOR PROTECTING BOILER IGNITORS

BACKGROUND

1. Field of the Invention

The present invention relates to a method and apparatus for preventing damage to boiler ignitors caused by exposure to extreme heat, the adhesion of flyash and clinkers, and electrical arcing. The method and apparatus involves passing cool air over the ignitors while the boiler is ignited and operating.

2. The Background of the Invention

One of the most complex and time consuming processes in the operation of coal-fired electric generating plants is the start-up of those plants. One of the major difficulties in the start-up involves igniting coal which is burned by the plant. In order to assure proper ignition of the coal it is necessary to go through a multiple step process which employs relatively complex and expensive equipment.

To initiate the burning of coal it is generally necessary to first ignite a more easily ignitable primer fuel. Thus, it is now common practice to inject into the plant's furnace atomized oil or diesel fuel, or, in the alternative, a stream of natural gas. The primer fuel is then ignited by introducing an electrical spark into the stream of primer fuel. Once the primer fuel stream is fully ignited, a stream of pulverized coal can be gradually introduced into the furnace along with the primer fuel while still maintaining combustion in the furnace. Eventually, combustion is totally sustained by the stream of coal, at which time the stream of primer fuel is discontinued.

One widely used method of igniting a coal stream in a coal-fired generating plant employs a specially designed ignitor device. One such ignitor is the Type MPO Lighter manufactured by Babcock & Wilcox Power Generation Group. This lighter comprises a means for injecting primer fuel, such as fuel oil, into a furnace, together with an apparatus for atomizing the oil. The lighter also includes an electrically operated ignitor probe which can be pneumatically extended into or retracted from the furnace itself. The lighter is connected to an electrical power source so that a spark can be produced at the end of the ignitor.

As mentioned above, the process of starting the coal fire within a generating plant is relatively complex. Generally, the oil injector gun is inserted into the boiler with the oil injector being powered by a pneumatic cylinder which is part of the lighter assembly. A stream of steam is then passed through the oil injector gun, which is an integral part of the ignitor, and out into the furnace. This is done in order to purge any unwanted residue from the system. When this is accomplished the ignitor probes are inserted pneumatically into the furnace. Once extended the ignitor probes are fired electrically for approximately 25 seconds in order to burn any residual fuel within the oil injector gun and piping. At this point the start-up process itself can commence.

In order to begin the start-up process, oil is injected into the furnace and is atomized by steam or air from a separate source. The ignitor probe fires until the atomized oil begins to burn. It will be appreciated that alternative primer fuels, such as natural gas, could be substituted in order to initiate combustion.

Once the primer fuel is sufficiently ignited, pulverized coal is blown into the furnace in the vicinity of the existing flame. The coal combines with the primer fuel and is burned. Gradually, the amount of coal blown into the furnace is increased and the primer fuel discontinued and a completely coal-fired flame is produced. When this occurs the injector probes and the oil injector gun are withdrawn from the furnace.

One major problem with this process, and one of the problems which the current invention solves, is that of the deterioration and eventual destruction of some of the operative elements of the ignitor probes. Indeed, it is generally found that ignitor probes are only usable for one plant start-up process. After a cycle involving start-up and operation of the plant it is found that the center electrode of the ignitor probe is no longer usable. Even when the probe is retracted, the intense heat under which the entire process takes place damages the electrodes. Typically the ignitors operate at about 1500° F., and even when retracted are exposed to the intense radiant heat of the furnace. In addition, it is found that the end of the ignitor probe which contains the exposed electrodes often becomes coated with flyash and clinkers. As a result of the extremely hostile environment in which the ignitor probes must operate, it is not surprising that they are only used once and then replaced.

The cost of constantly replacing ignitor probes, however, is extremely high. In typical modern power plants, it is not unusual to have four banks of 10 ignitors, or a total of 40 ignitors. Each ignitor probe costs approximately $150, resulting in a cost for the probes alone of $6,000 per start up procedure. Added to the cost of the probes are the additional costs of taking the plant out of service, the resulting loss of generation of electricity, and the cost of labor required to change the probes. Primary among these costs is the loss of electric generation. It is estimated that the cost of taking a plant out of service is approximately $8,000 per hour. The probe replacement process can easily take 7 to 8 hours. As a result, it will be appreciated that each time the ignitor probes must be replaced, which is essentially each time a plant goes through the start-up procedure, the cost is in the range of $50,000 to $70,000.

It will be appreciated, therefore, that what is needed in the art are methods and apparatus for protecting the ignitor probes from damage in order to enable them to be reused. Specifically, it has been found that if the probes can be kept at a temperature in the general range of 200° F., much of the expected damage can be prevented. If, in addition, flyash and clinkers can be kept off the probes, most probes can be maintained in relatively good condition. Therefore, it would be an advancement in the art if methods and apparatus could be provided which would keep the ignitor probes cool and at the same time keep flyash and clinkers away from the probes. It would be an additional advantage if existing ignitor assemblies could be retrofit with such an invention. Such methods and apparatus are disclosed and claimed in this application.

BRIEF SUMMARY AND OBJECTS OF THE INVENTION

The present invention includes novel methods and apparatus for protecting ignitor probes while they are in place within the furnace area of a coal-fire electric power plant. The present invention involves connecting the ignitor support tube to a source of pressurized cool air which then passes over the ignitor probes while they are in the retracted position.

This can be done with modification of existing ignitor assemblies. Typically, the ignitor support comprises a tube which houses the electrical connections for the ignitor probe. Thus, within the tube there is usually an area not occupied by the electrical connection which would permit the passage of air under pressure. The modifications within the scope of the current invention include forcing air through the ignitor support tube. The injected air travels down the ignitor support tube and eventually exit through a plurality of small holes provided in the ignitor support tube. From there the air passes over the ignitor probe and exhausts into the furnace. The relatively small volume of air entering the furnace simply combines with the emissions from the furnace, causing no significant impact on the furnace's operation. On the other hand, this small amount of air provides signicant benefits, as described below. When the probes are inserted into the furnace to ignite the primer fuels, the air flow is stopped by a solenoid valve or any other suitable type of switch mechanism.

It is found that by employing this method and apparatus that the ignitor probes can be easily and adequately protected. The probes are cooled by the air passing thereover such that they are kept at a lower temperature as opposed to their usual operating temperature of 1500° F. The positive air flow behind the ignitor probes also forces flyash and clinkers away from the ends of the probes. Thus, foreign material is not allowed to deposit on or foul the spark gap of the probe's center electrode.

Accordingly, it is the general object of the present invention to provide a method and apparatus for protecting ignitor probes, in coal-fire plants, from damage and disintegration.

It is a further object of the present invention to provide methods and apparatus for keeping ignitor probes free from flyash and clinkers while the furnace is in operation.

It is a related object of the present invention to accomplish the above-identified objects by passing cool air, or other gases, over the ignitor probe.

It is an additional object of the present invention to provide such methods and apparatus such that existing ignitor assemblies can be retrofit with the current invention.

These and other objects of the invention will become apparent upon reading the following detailed description and appended claims, and upon reference to the accompanying drawings.

DETAILED DESCRIPTION OF THE PREFERRED EMBODIMENTS

Figure 1:
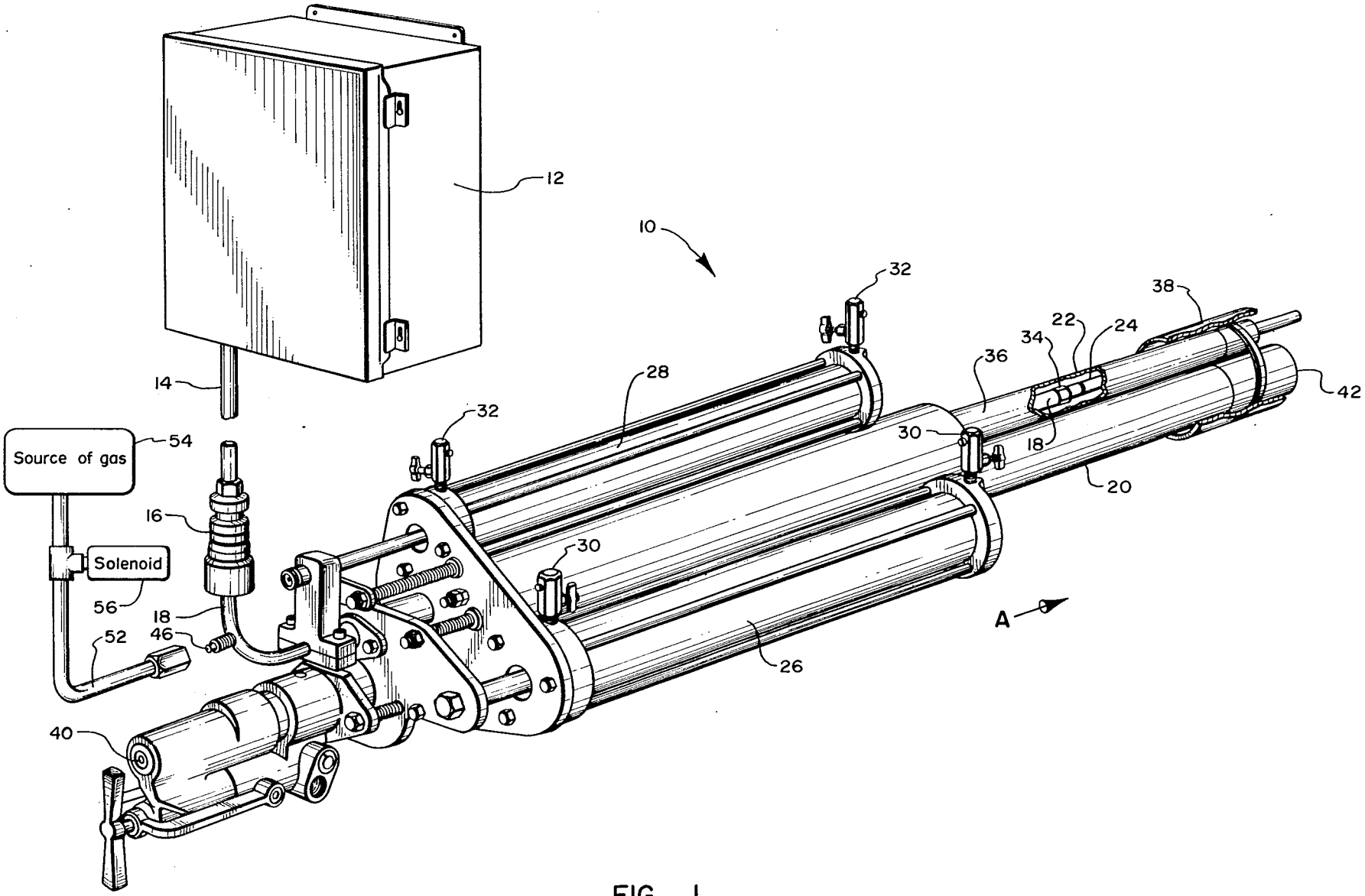
FIG. 1 is a perspective view of a furnace lighter with portions broken away to more fully illustrate the position of the various parts related to the ignitor probe.

The present invention can be best understood by reference to the drawings wherein like parts are designated with like numerals throughout. The present invention comprises modifications to existing ignitors such that cool air can flow over the ignitor probes. Referring more particularly to FIG. 1, a commonly used furnace lighter, generally designated 10, is illustrated. The lighter 10 is connected to an electric power source 12. The power source 12 has a cable 14 which extends to a point of connection 16 with an ignitor support tube 18 of the lighter 10. For illustrative purposes, the lighter 10 in FIG. 1 is a Babcock & Wilcox Type MPO Lighter, a type of lighter commonly used in the electric power generating industry. It should be understood, however, that the present invention may be applicable to other similar types of lighters.

Other operative features of the conventional lighter 10 are also illustrated in FIG. 1. Primary among these features are oil gun 20, an ignitor assembly generally designated 22, and an ignitor probe 24. The rear of the ignitor probe 24 is shown in the area of the ignitor assembly 22 which is broken away. The oil gun 20 and the ignitor probe 24 are moveable and are powered by pneumatic cylinders designated 26 and 28, respectively. The pneumatic cylinders 26 and 28 also have connections which allow the pneumatic cylinders to operate, as will be more fully discussed below. The connections to the pneumatic cylinder 26 are designated 30 and the connections to the pneumatic cylinder 28 are designated 32.

The ignitor support tube 18 is attached to ignitor probe 24 at a coupling 34. Circumscribing ignitor probe 24 and ignitor support tube 18 is an ignitor sleeve 36. Ignitor sleeve 36 provides partial protection for ignitor probe 24, especially while ignitor probe 24 is withdrawn into ignitor sleeve 36. The lighter 10, also has a heat shield 38 which circumscribes the end portions of both the ignitor sleeve 36 and the oil gun 20, as best illustrated in FIG. 1 wherein the heat shield 38 is partially broken away. The heat shield 38 provides additional protection for the ends of the ignitor probe 24 and the oil gun 20 which extend into the furnace, and after ignition are retracted.

As mentioned briefly above, the lighter 10 is used to initiate combustion within the furnace of a coal-fired plant, such as a coal-fired electric generation plant. In order to initiate combustion, a multi-step procedure is typically followed. The oil gun 20 is powered by pneumatic cylinder 26 into the furnace in the direction of arrow A in FIG. 1. Steam is passed through oil gun 20 by being introduced into the rear opening 40 of the oil gun 20. The steam passes through oil gun 20 and exits into the furnace through the furnace opening 42 of the oil gun 20. The ignitor probe 24 is then extended into the furnace, in the direction of arrow A, being powered by pneumatic cylinder 28. Ignitor probe 24 is fired for a short period of time by electric power source 12. The electric power source 12 will typically operate at approximately 2000 volts and 12 Joules. This initial firing burns any residual fuel in the vicinity of the lighter 10.

Once this cleaning process is complete, oil is injected into the furnace through oil gun 20 and is ignited by the continuous firing of ignitor probe 24. Once the oil ignites, ignitor probe 24 is withdrawn into ignitor sleeve 36, again driven by pneumatic cylinder 28. Oil, atomized by steam, continues to be injected into the furnace and burned.

When certain predetermined conditions are met and the oil flame is sufficiently stable, pulverized coal and air are fed into the furnace in the vicinity of the oil flame. The amount of pulverized coal is gradually increased. Once ignition of the pulverized coal stream occurs fully, injection of the oil is terminated and the oil gun 20 is withdrawn from the furnace into the interior of heat shield 38.

Figure 3:
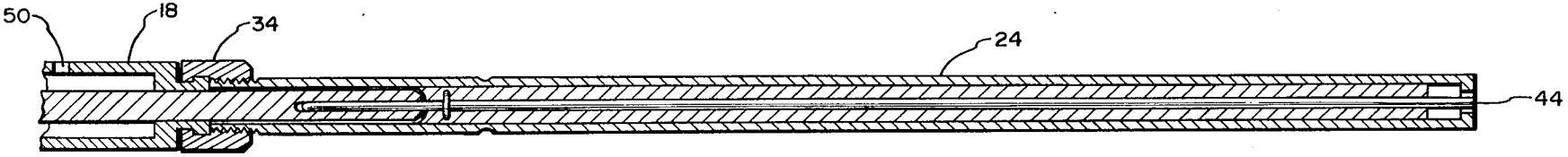
FIG. 3 is a longitudinal-section view of the ignitor probe and its connection to the ignitor support tube.

One of the major problems which develops, is that the ignitor probe 24, even when withdrawn into ignitor sleeve 36 and heat shield 38, is still exposed to an extreme and very adverse environment. The tip of center electrode 44, as illustrated in FIG. 3, of the ignitor probe 24 is still exposed to the extreme heat of the operating furnace, flyash and clinkers. The result is that ignitor probes 24 are only fit for use once and then must be replaced at great expense.

Figure 2:
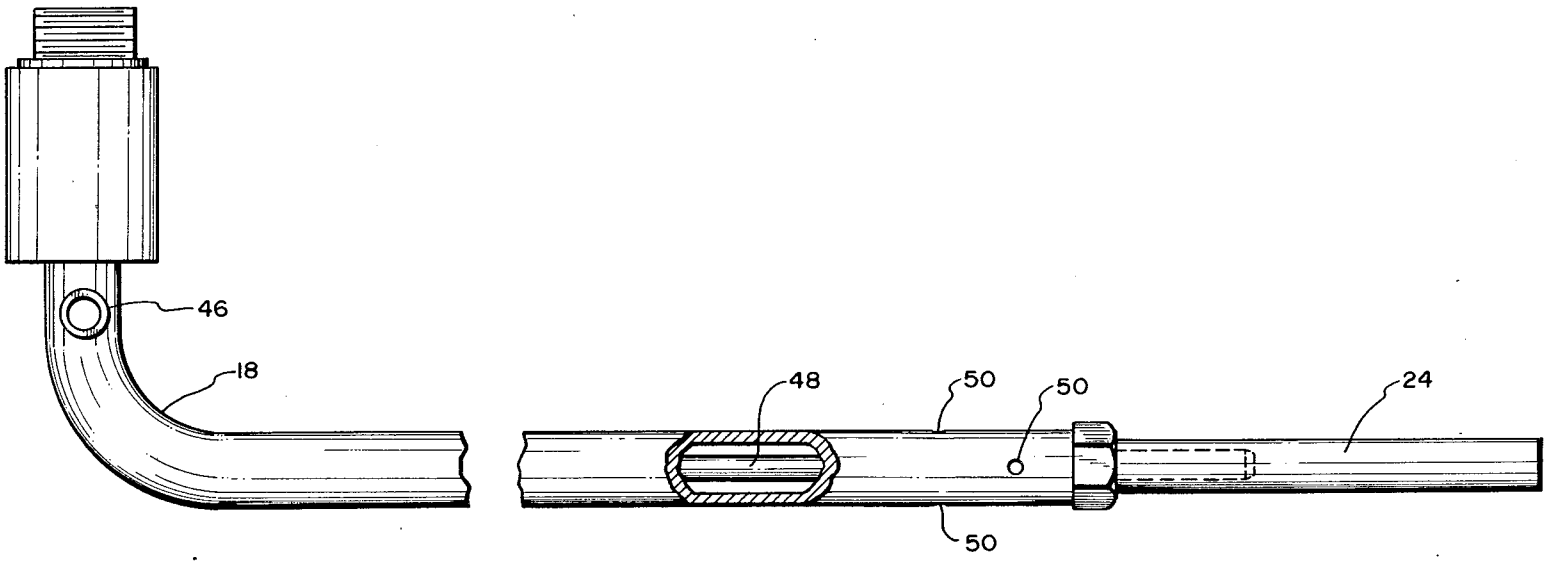
FIG. 2 is a side elevational view of the ignitor and the ignitor support tube with a portion broken away to more fully illustrate their construction.

The present invention is directed to preventing the rapid destruction of the ignitor probe 24. The current invention introduces a stream of air, or other relatively inert gas, which is passed over the ignitor probe 24 and out into the furnace in the direction of arrow A shown in FIG. 1. As illustrated in FIG. 1, an input connector or nipple 46 is provided which is capable of being attached to a tube 52 carrying compressed gas from a compressed gas source, generally designated 54. Compressed gas is injected into the nipple 46. It has been found that gas at a pressure of approximately 50 pounds per square inch is satisfactory. The nipple 46 is welded or otherwise attached to the ignitor support tube 18. As illustrated in FIGS. 2 and 3, a plurality of small holes 50 are formed in ignitor support tube 18 at the end of ignitor support tube 18 near the coupling 34 with ignitor probe 24. In a preferred embodiment four $\frac{1}{8}$ inch holes 50 are used.

The compressed gas introduced to the nipple 46 from the compressed gas source 54 enters the interior of ignitor support tube 18 and travels down the ignitor support tube 18 toward the ignitor probe 24. The gas envelops and travels parallel to and around a conductor cable 48, the electrical connection, which is positioned within ignitor support tube 18. The spatial relationship between the conductor cable 48 and the ignitor support tube 18 can be best appreciated by reference to FIG. 2. The gas then exits the small holes 50 in the ignitor support tube 18 into the ignitor sleeve 36. The ignitor sleeve 36 then directs the compressed gas to exit into the furnace. Consequently, the gas exiting the small holes 50 passes over the ignitor probe 24, particularly the tip of the ignitor probe 24 which includes the exposed portion of the center electrode 44. It will be appreciated that gas is injected into the device only while the ignitor probe 24 is in the retracted position. When the ignitor probe 24 is extended into the furnace, the gas stream is shut off by a solenoid valve 56 or some other appropriate means.

Other alternative means of delivering a stream of gas to the exposed portion of the ignitor probe 24 are of course possible. For example, it may be possible to run the gas tube 52 parallel to the ignitor support tube 18 so that gas exiting the tube 52 passes directly over the ignitor probe 24 without ever entering the ignitor support tube 18. The primary object of the invention is the delivery of a cool gas stream to the ignitor probe 24 such that the ignitor probe 24 is protected. A variety of means for accomplishing this object could be imagined and are considered to be within the scope of the current invention.

It will be appreciated that the stream of compressed air or other gas passing over the end of ignitor probe 24 provides protection to the probe 24. The gas injected is relatively cool and thus cools the ignitor probe 24. In addition, the constant stream of cool gas tends to insulate the ignitor probe 24 from the heat produced within the furnace. The tip of the ignitor probe 24 and its center electrode 44 are particularly protected by the gas turbulence experienced near the tip of the ignitor probe 24. Indeed, in initial tests of the present invention it has been found that the temperature of the ignitor probe 24 has been reduced to approximately 200° F., from its operating temperature of approximately 1500° F. This reduction of temperature, while the ignitor probe 24 is in the retracted position, substantially reduces the possibility of damage, particularly to the exposed portion of the delicate center electrode 44.

A related benefit of the air stream which passes over the ignitor probe 24 is the capability of preventing waste products from the combustion of coal from depositing on the ignitor probe 24. Some of the major causes of deterioration of the ignitor probe 24 include deposits of flyash, clinkers and other waste products on the ignitor probe 24. This fouls the ignitor probe 24 and may accelerate the corrosion which is experienced near the tip of the probe 24. When the current invention is employed, however, the positive air flow around the ignitor probe 24 tends to drive the combustion waste products away from the ignitor probe 24. The current invention, therefore, serves to protect and preserve the ignitor probe 24 while it is in the retracted position. This is done inexpensively and with a very simple apparatus, yet the potential savings are extraordinary. For example, it has been found that when employing the current invention, ignitor probes have easily survived for extended periods in an operating furnace without damage.

The invention may be embodied in other specific forms without departing from its spirit or essential characteristics. The described embodiment is thus to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

What is claimed and desired to be secured by U.S. Letters Patent is:

1. A method for protecting the retracted ignitor probe of a furnace lighter from damage during operation of the furnace, comprising the steps of:

providing a furnace lighter with an ignitor sleeve and an ignitor probe; said ignitor probe being retracted into the ignitor sleeve and being connected to an ignitor support tube at a coupling;

installing a connector, capable of receiving a gas, on the ignitor support tube remote from the coupling between the ignitor support tube and the ignitor probe;

providing an outlet for said gas through the ignitor support tube near the coupling between the ignitor support tube and the ignitor probe; and injecting a cool gas into the connector capable of receiving a gas such that the gas passes into the ignitor sleeve and over the ignitor probe, thereby cooling the ignitor probe and deterring deposits of waste material on the ignitor probe.

2. A method for protecting the retracted ignitor probe of a furnace lighter from damage during operation of the furnace as defined in claim 1 wherein said ignitor sleeve is positioned such that it encloses at least a portion of said ignitor probe and the ignitor support tube such that said gas exiting the outlet for said gas is directed into the ignitor sleeve along the ignitor probe and passes into the furnace.

3. A method for protecting the retracted ignitor probe of a furnace lighter from damage during operation of the furnace as defined in claim 1 wherein the step of installing a connector further comprises attaching a nipple capable of receiving said gas onto said ignitor support tube.

4. A method for protecting the retracted ignitor probe of a furnace lighter from damage during operation of the furnace as defined in claim 1 wherein the outlet comprises a plurality of holes in said ignitor support tube.

5. A method for protecting the retracted ignitor probe of a furnace lighter from damage during operation of the furnace as defined in claim 1 further comprising the step of attaching to a source of said stream of cool gas supplied to said connector a means for selectively turning off said stream of gas.

6. A method for protecting the retracted ignitor probe of a furnace lighter from damage during operation of the furnace as defined in claim 5 wherein the attaching step comprises securing a solenoid valve to said source of gas and selectively closing said solenoid valve.

7. A method of protecting an ignitor probe from damage while it is in the retracted position within an operating furnace comprising the steps of:

(a) providing a furnace lighter with an ignitor sleeve, an ignitor support tube and an ignitor probe; said ignitor probe being retracted into said ignitor sleeve and being connected to said ignitor support tube at a coupling;

(b) attaching a gas inlet connector to the ignitor support tube remote from the coupling between the ignitor support tube and the ignitor probe, said gas inlet connector being capable of directing a stream of cool gas from a gas source into the ignitor support tube;

(c) forming a plurality of holes through the ignitor support tube near the coupling between the ignitor support tube and the ignitor probe;

(d) attaching a source of pressurized gas to said gas inlet connector; and (e) commencing the flow of the gas through the gas inlet connector, into the interior of said ignitor support tube, entering out said holes and around said ignitor probe, whereby the gas insulates the ignitor probe from heat from the opeating furnace.

8. A method of protecting an ignitor probe from damage while it is in the retracted position within an operating furnace as defined in claim 7 further comprising the step of providing a means for turning off said gas when said probe is moved from the retracted position.

9. A method of protecting an ignitor probe from damage while it is in the retracted position within an operating furnace as defined in claim 8 wherein said means for turning off said gas when said probe is moved out from the retracted position comprises a solenoid valve which is caused to close when said ignitor probe moves out of the retracted position.

10. A method of modifying a furnace lighter to protect the ignitor probe of the lighter from damage while in the retracted position, comprising the steps of:

(a) providing a furnace lighter having an ignitor probe and a hollow ignitor support tube connected to the ignitor probe at a coupling, the hollow of said ignitor support tube defining a space within the interior of the ignitor support tube sufficient to permit the passage of a gas along the length of said ignitor support tube;

(b) connecting a gas inlet connector for directing a gas from a gas source into the interior hollow space within said ignitor support tube;

(c) providing outlet means through said ignitor support tube for said gas to exit said ignitor support tube near the coupling between said ignitor support tube and said ignitor probe, such that said gas travels around said ignitor probe and out into said furnace.

11. A method of modifying a furnace lighter as defined in claim 10 wherein the step of providing a means for said gas to exit said ignitor support tube comprises forming a plurality of holes in said ignitor support tube near the coupling between said ignitor support tube and said ignitor probe.

12. An ignitor protection assembly comprising:

an ignitor support tube connected to an ignitor probe at a coupling;

a connector, capable of receiving a gas, on the ignitor support tube remote from the coupling between the ignitor support tube and the ignitor probe;

an outlet for the gas through the ignitor support tube near the coupling between the ignitor support tube and the ignitor probe;

means for delivering a stream of cool gas to the exterior of the ignitor probe;

whereby said gas cools said ignitor probe and deters deposits of waste material on the ignitor probe.

13. A ignitor protection assembly as defined in claim 12 wherein said outlet comprises a plurality of holes in said ignitor support tube proximate to the coupling between the ignitor support tube and said ignitor probe.

14. An ignitor protection assembly as defined in claim 12 wherein said gas inlet connection is welded to said ignitor support tube.

15. A furnace lighter comprising:

a selectively retractable ignitor probe reciprocably extendable into a furnace;

fluid actuator means for displacing the ignitor to its extended position and for returning the ignitor to its retracted position;

means for communicating electrical power to the ignitor probe;

means for injecting a priming fuel into the furnace in the vicinity of the ignitor probe; and means for passing a cooling gas over the tip of the ignitor probe when said probe is in the retracted position.

16. A furnace lighter comprising:

means for injecting a fuel into a furnace;

a retractable ignitor probe connected to a source of electricity;

actuator means for displacing the ignitor to its extended position and for returning the ignitor to its retracted position;

an ignitor support tube having an interior space sufficient to allow passage of a gas through said ignitor support tube said ignitor support tube being coupled to said ignitor probe;

an ignitor sleeve circumscribing a portion of said ignitor probe and said ignitor support tube while said ignitor probe is in the retracted position;

said ignitor support tube further comprising a gas inlet connection remote from the coupling between said ignitor support cable and said ignitor probe and a gas outlet proximate to said connection between said ignitor support tube and said ignitor probe such that gas flowing into said gas inlet will flow out said gas outlet and surround the ignitor probe such that the ignitor probe is protected from the heat of the furnace and from deposits of residue from the furnace.

17. A furnace lighter as defined in claim 16 wherein said gas inlet connection comprises a nipple capable of directing gas from a source of gas into the interior space within said ignitor support tube.

18. A modified furnace lighter as defined in claim 17 wherein said gas outlet comprises a plurality of holes in said ignitor support tube.

19. A method for protecting an ignitor probe of a furnace lighter from damage during the operation of the furnace comprising the steps of:

providing a furnace lighter comprising a selectively retractable ignitor probe reciprocably extendable into a furnace, actuator means for displacing the ignitor to its extended position and for returning the ignitor to its retracted position, means for communicating electrical power to the ignitor probe and means for passing a cooling gas over the tip of the ignitor probe when said probe is in the retracted position;

placing the ignitor probe in its retracted position; and passing cooling gas over the tip of the ignitor probe.

* * * * *

UNITED STATES PATENT AND TRADEMARK OFFICE

CERTIFICATE OF CORRECTION

PATENT NO. : 4,613,302

DATED : September 23, 1986

INVENTOR(S) : Derald Oliver

It is certified that error appears in the above-identified patent and that said Letters Patent are hereby corrected as shown below:

Col. 3, line 10, "exit" should be --exits--

Col. 3, line 17, "signicant" should be --significant--

Col. 4, line 8, "generating" should be --generation--

Col. 7, line 49, "opeating" should be --operating--

Col. 8, line 29, delete ";"

Col. 8, line 30, should be continuation of line 29, not a new subparagraph

Col. 8, line 32, "A ignitor" should be --An ignitor--

Col. 8, line 68, "cable" should be --tube--

Signed and Sealed this

Seventh Day of April, 1987

*Attest:*

*Attesting Officer*

DONALD J. QUIGG

*Commissioner of Patents and Trademarks*